US005807000A

United States Patent [19]

Kawamura et al.

[11] Patent Number: 5,807,000

[45] Date of Patent: Sep. 15, 1998

[54] THERMAL TRANSFER PRINTER SYSTEM AND RECORDING UNIT

[75] Inventors: Katsumi Kawamura; Minoru Suzuki, both of Tokyo, Japan

[73] Assignee: Asahi Kogaku Kogyo Kabushiki Kaisha, Tokyo, Japan

[21] Appl. No.: 645,268

[22] Filed: May 13, 1996

[30] Foreign Application Priority Data

May 17, 1995 [JP] Japan ..... 7-142701

[51] Int. Cl.[6] ..... B41J 31/00; B41J 2/325

[52] U.S. Cl. ..... 400/237; 400/120.02; 400/120.03; 400/240; 347/174; 347/175

[58] Field of Search ..... 400/193, 207, 400/208, 237, 246, 240, 238, 120.02, 120.03, 120.04; 347/172, 173, 174, 175, 176

[56] References Cited

U.S. PATENT DOCUMENTS

| | | | |
|---|---|---|---|
| 4,952,974 | 8/1990 | Mori . | |
| 5,101,222 | 3/1992 | Hakaku . | |
| 5,362,549 | 11/1994 | Imamura et al. | 428/195 |
| 5,463,417 | 10/1995 | Yamakawa | 347/175 |
| 5,610,649 | 3/1997 | Kokubo | 347/175 |
| 5,625,394 | 4/1997 | Fukuda et al. | 347/175 |

FOREIGN PATENT DOCUMENTS 1540660 4/1997 United Kingdom .

*Primary Examiner*—John S. Hilten
*Attorney, Agent, or Firm*—Greenblum & Bernstein, P.L.C.

[57] ABSTRACT

A recording unit is formed by successively adhering layers of ink donor film of differing colors to each other. A bottom layer is adhered to an image receiving sheet, along a top edge of the recording unit. The image receiving sheet is longer than the ink donor films. In order to print a color image, the bottom ink donor film is layered onto the image receiving sheet, while the rest of the ink donor films are flipped away from the image receiving sheet. The layered film and sheet are fed from a print starting position through a thermal transfer printer that feeds and prints the film and sheet in a forward direction to a print termination position, and then feeds the film and used sheet in a reverse direction to the print starting position. The used film is removed, the next film layered onto the image receiving sheet, and the process is repeated until all the ink donor films have been used.

32 Claims, 4 Drawing Sheets

I / F
27
PDATA1~8
DATASTB
BUSY
ACK
107
108LED
109
GND
G / A
26
X'tal
15
GND
AB
DB
AB23~0
DB15~0
CPU
AN1
Port1
Port2
Port3
Port4
Port5
Port6
RESET
PTOP
Port7
Port PON2
AN2 8 PON1
10
RESET IC
24
25
EPROM
21
DRAM
22
ROM
23
THERMAL PRINT HEAD
40
41
CLK
DATA1
DATA2
STB1
STB2
STB3
STB4
CHARGE
REFRESH
MOTOR DRIVE CCT.
31
M
32
A
A
B
B
CHARGE CONTROL CCT.
60
CC
CV
GND
70
80
81
82
51
52
53
VCC
ADPT.IN
SW
VH
V−Batt
DC/DC CONVERTER
50
VCC
POWER SW
106
90
Batt.

START
RECORDING UNIT PRESENT ?
NO
S11
YES
BEGIN PAPER FEED
S13
PRINT START POSITION ?
NO
S15
YES
MOTOR STOPS
S16
MOTOR PULSE NUMBER INITIALIZED
S17
MOTOR STARTS (FWD)
S19
PRINT
S21
Nth COUNT ?
NO
S23
YES
MOTOR STOPS
S25
3rd COLOR ?
YES
S27
S41
NO
PAPER EJECT
MOTOR PULSE NUMBER IS INITIALIZED
S31
END
MOTOR STARTS (RUS)
S33
Nth COUNT ?
NO
S35
YES

THERMAL TRANSFER PRINTER SYSTEM AND RECORDING UNIT

BACKGROUND OF THE INVENTION

The present invention relates to a thermal transfer printer in which a color image is formed on an image receiving medium using a thermal line print head.

In a conventional color thermal transfer printer, an ink ribbon having sequential ink areas of cyan, yellow, and magenta colors is wound on a roll. When forming an image, the yellow color area of the ribbon is fed through the thermal transfer printing area together with the image receiving sheet to transfer the yellow color component, then the image receiving sheet is returned to a position to be fed again. Subsequently, the magenta ink area is fed together with the image receiving sheet to transfer the magenta color component, the image receiving sheet is returned, then the cyan ink area is fed with the image receiving sheet to transfer the cyan color component. The respective color information is thus sequentially printed by superimposing successive color components on the image receiving medium, thereby forming a color image on the image receiving sheet.

However, when transferring a color print in a conventional thermal transfer printer as described, it is necessary that the thermal transfer printer is provided with an ink ribbon roll and a holder portion for the ink ribbon roll. Such a printer is bulky and heavy, and the ink ribbon roll is also bulky.

SUMMARY OF THE INVENTION

It is therefore an object of the present invention to provide a compact and light thermal transfer printer which is able to make color prints without an ink ribbon held therein, and to provide a recording unit that is usable in a thermal printer without an ink ribbon held therein.

In order to meet these objects, according to one aspect of the present invention, a printer system, includes a recording unit having an image receiving sheet and a plurality of ink donor films of differing colors layerable on the surface of the receiving sheet. Each of the ink donor films is removable from the image receiving sheet. The printer system further includes a printing head and a feeding device that feeds the image receiving sheet and a predetermined one of the ink donor films (layered on the image receiving sheet) past the printing head, in a forward direction, from a print starting position to a print termination position, and in a reverse direction, from the print termination position to the print starting position. Also included is a detector that detects a feeding distance of the image receiving sheet in the forward and reverse directions; and a controller that controls the feeding device to stop when the image receiving device reaches the print starting position and the print termination position.

According to another aspect of the invention, a printer system includes a recording unit having an image receiving sheet and a plurality of ink donor films of differing colors, layerable on the surface of the image receiving sheet. Further, the printer system includes a thermal printhead that forms an image on a recording sheet via at least one of the plurality of ink donor films; and a feeding device that feeds the recording unit past the thermal printhead. A control device controls the feeding device and the thermal printhead, to feed the image receiving sheet layered together with each one of the plurality of ink donor films, in a forward direction, from a starting position past the thermal printhead to form a color component image, and to feed the image receiving sheet layered together with the each one of the plurality of ink donor films, in a reverse direction, to the starting position.

Accordingly, the printer system can repeat cycles of forward and reverse feeding until all of the layerable ink donor films have been used to form a color component image and a full color image can be formed without any particular ribbon housed in the printer. In this case, the printer system preferably includes a detector that detects a feeding distance of the image receiving sheet in the forward and reverse directions.

In this manner, the printer system of each of these aspects of the invention can repeat cycles of forward and reverse feeding until all of the layerable ink donor films have been used to form a color component image and a full color image can be formed without any particular ribbon housed in the printer. That is, the first layerable ink donor film having a first color component image is layered on the image receiving sheet, and is then fed in a forward direction from the print starting position to the print termination position while the first color component image is transferred from the first ink donor film, and is then reversed to the print starting position. Subsequently, the used first color component ink donor film is removed by the user, and the forward and reverse cycles can be repeated with several layerable ink donor films having several color components, until a full color image is obtained.

Preferably, each of the plurality of ink donor films is shorter in a feeding direction than the image receiving sheet. Accordingly, the image receiving sheet may be fed in forward and reverse directions while still allowing the ink donor films to be separated and layered at the print starting position. In this case, a distance from the print starting position to the print termination position is preferably longer than each of the plurality of ink donor films and shorter than the image receiving sheet.

In one particular development of these aspects of the invention, the controller controls the feeding device to feed the image receiving sheet of the recording unit, in the forward and in the reverse directions, a number of times corresponding to a number of the plurality of ink donor films. Accordingly, the feeding is cycled a number of times corresponding to the number of color component ink donor films. In this case, the controller preferably includes a counting device that counts the number of times the image receiving sheet is fed in the forward and in the reverse directions, and a checking device that checks if the number of times corresponds to the number of the plurality of ink donor films.

The controller preferably controls the feeding device to eject the recording unit from the feeding device in response to the checking device, so that when the printing of the full color image is complete, the recording unit is removed from the printing process.

According to another particular development of these aspects of the invention, the printer system includes an operating switch, and the controller includes a switch checking device. The switch checking device is connected to the operating switch, and pauses the feeding before each feeding of the image receiving sheet in the forward direction. The controller feeds the image receiving sheet in the forward direction when the switch checking device detects an operation of the operating switch.

In this manner, between each cycle of forward and reverse feeding of the recording unit, the printer system waits until the operator signals that one color component ink donor film has been separated and another layered on the image receiving sheet by operating the operating switch.

According to still another aspect of the invention, a recording unit for use with a thermal transfer printer includes: an image receiving sheet; and a plurality of ink donor films of differing colors layerable on the surface of the receiving sheet, each of the ink donor films being shorter than the image receiving sheet and removable from the image receiving sheet.

This recording unit may be used with a printer, and on successive printing passes, each of the ink donor films may be successively layered on the surface of the image receiving sheet and subsequently removed, allowing full color imaging onto the image receiving sheet without any particular ribbon or inks provided to the printer itself. That is, a first layerable ink donor film having a first color component image is layered on the image receiving sheet, is fed in a forward direction as the first color component image is transferred from the first ink donor film, and is then reversed. Subsequently, the used first color component ink donor film is removed by the user, and the forward and reverse cycles can be repeated with several layerable ink donor films having several color components, until a full color image is obtained.

Advantageously,. the plurality of ink donor films are successively layered on the image receiving sheet and successively attached to an adhering portion extending along one end of the image receiving sheet in a direction perpendicular to the feeding direction of the recording unit.

In one particular development of this aspect of the invention, the plurality of ink donor films and the image receiving sheet are formed with perforations, parallel to and at the edge of the adhering portion, for separating each of the plurality of ink donor films and the image receiving sheet from the adhering portion. Consequently, an image donor film may be easily separated from the adhering portion at the perforations, after each pass (forward and reverse cycle) through a printing process.

According to another particular development of this aspect of the invention, the adhering portion is formed by successively adhering the image receiving sheet and each of the plurality of ink donor films at the one feeding direction end of the image receiving sheet. In this manner, the layers of ink donor films and the image receiving sheet are easily stacked up and easily adhered to one another during assembly. Furthermore, since the thickness of the adhering portion is therefore the same thickness as the stack of image receiving sheet and ink donor films, the adhering portion may be easily fed through a printer as part of the recording unit.

In this case, in a possible modification of the invention, the adhering portion successively adheres the image receiving sheet and each of the plurality of ink donor films by means of a peel-off adhesive. The use of a peel-off adhesive allows each image donor film to be separated from the adhering portion, without tearing, after each pass through a printing process, by peeling the image donor film from the adjacent ink donor film at the adhering portion. Therefore, although the recording unit is resistant to coming apart in normal use, the ink donor films can be easily removed from the recording unit at the appropriate time.

Preferably, the image receiving sheet is substantially as wide, in a direction perpendicular to a feeding direction of the recording unit, as each of the plurality of ink donor films, but is longer by a predetermined extending portion, in the feeding direction and at an opposite end of the recording unit to the adhering portion, than each of the plurality of ink donor films. Accordingly, the predetermined extending portion may be gripped by a feeding mechanism of the printer, and the image receiving sheet may be fed in forward and reverse directions while still allowing the ink donor films to be separated and layered at the print starting position. That is, if the recording unit is positioned such that the predetermined extending portion is gripped by a feeding mechanism of a printer but the ink donor films are not, the ink donor films may be separated from the recording unit while the image receiving sheet remains at the gripped position and the already printed image remains at a registered position, allowing the ink donor films to be removed without disturbing the registration of the images. Furthermore, subsequent images can be accurately registered with existing color component images, as the next color component ink donor film can be layered onto the image receiving sheet while the image receiving sheet remains in the gripped position. Preferably, the extending portion corresponds to a lower margin defining a printable image area of the image receiving sheet, so that there is no loss in available printing area because of the extending portion.

According to still another development of this aspect of the invention, each of the plurality of ink donor films is treated by aluminum vapor deposition.

Preferably, the plurality of ink donor films includes at least three ink donor films, including a cyan ink donor film, a magenta ink donor film, and a yellow ink donor film. Alternatively, the plurality of ink donor films includes at least four ink donor films, including a cyan ink donor film, a magenta ink donor film, a yellow ink donor film, and a black ink donor film.

DETAILED DESCRIPTION OF THE PREFERRED EMBODIMENTS

Figure 1:
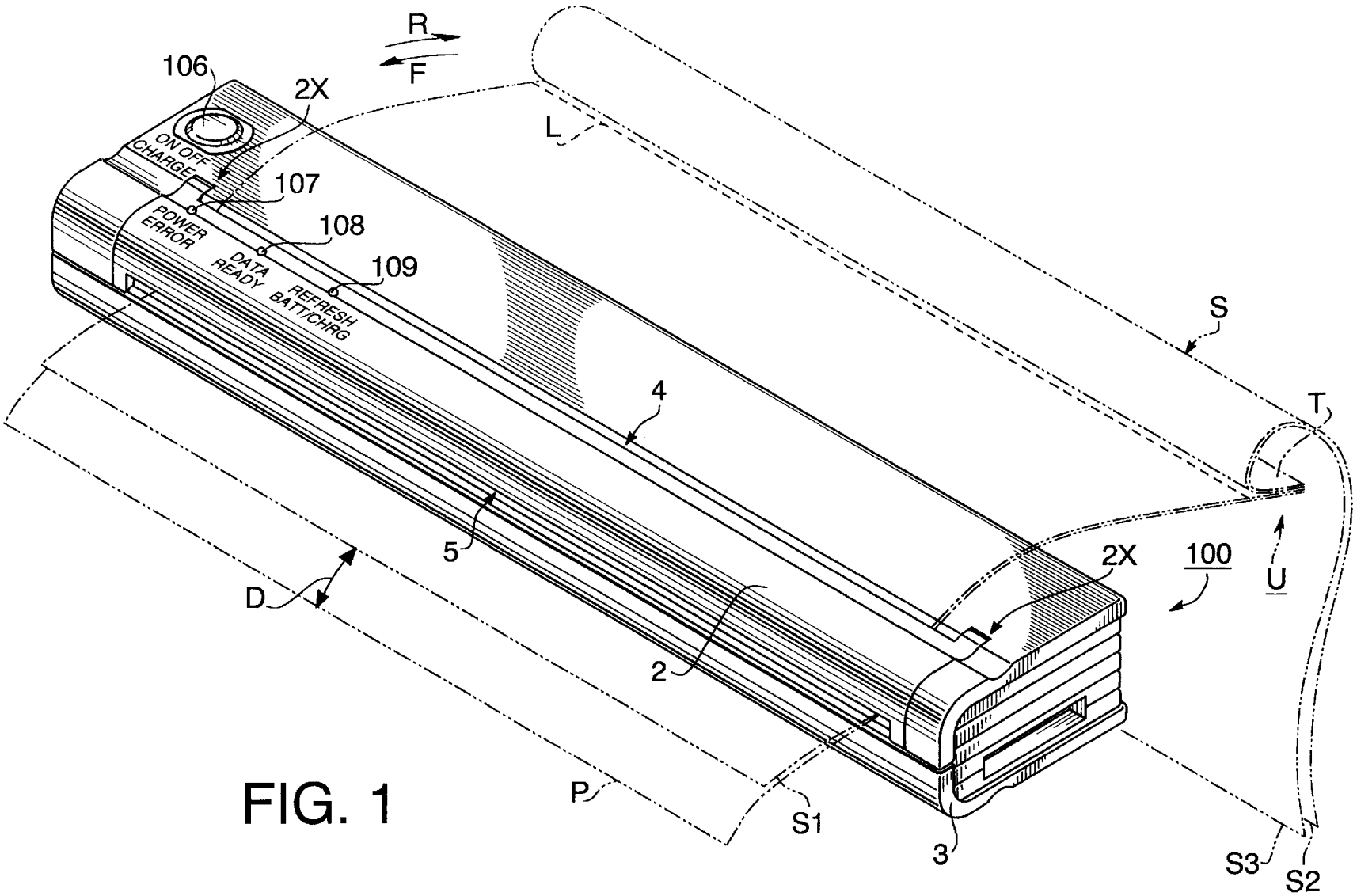
FIG. 1 is a perspective view of a thermal line printer and a recording unit according to a preferred embodiment of the invention.
Figure 2:
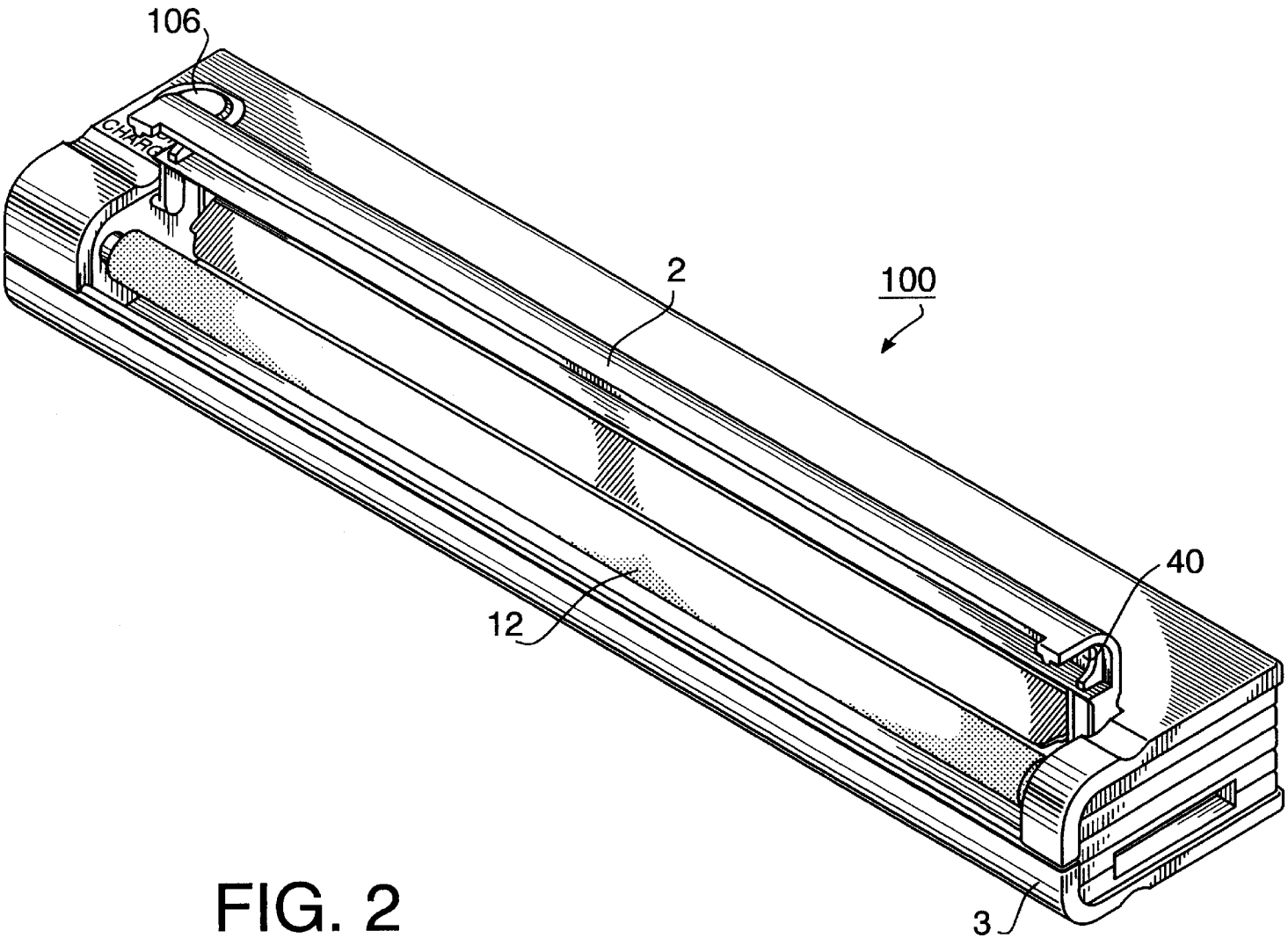
FIG. 2 is a perspective view showing the thermal line printer with a cover in an open position.

FIGS. 1 and 2 are perspective views showing a recording unit U and a thermal transfer printer 100 according to the preferred embodiments of the invention.

The recording unit U, as shown by double dotted lines in FIG. 1, is formed of four layered sheets. The bottom sheet is an image receiving sheet P, preferably of A4 size. A yellow ink donor film S1, a magenta ink donor film S2, and a cyan ink donor film S3 are layered above the image receiving sheet P. All of the layers are adhered by an adhering portion T at the upper end of the image forming sheet P.

Specifically, the adhering portion T is formed by successively adhering the yellow ink donor film S1 to the image receiving sheet P, the magenta ink donor film S2 to the yellow ink donor film S1, and the cyan ink donor film S3 to the magenta ink donor film S3, at a narrow top portion (the adhering portion T) having a predetermined width. The adhering is affected with a conventional adhesive.

The image receiving sheet P and ink donor films S1, S2, S3 are separable from the adhering portion T. That is, in the preferred embodimnent, each of the image receiving sheet P and ink donor films S1, S2, and S3 have perforations L extending parallel to the adhering portion T, and the image receiving sheet P and ink donor films S1, S2, and S3 are separable from the adhering portion T via the perforations L.

Alternatively, the adhesive that attaches each of the ink donor films S1, S2, and S3 to its neighboring surface may be of the peel-off type that retains adhering properties over an extended period without drying and without transferring adhesive to the neighboring surface, whereby the perforations L are not necessary, and each successive image donor film S1, S2, and S3 may be peeled from the adhering portion T.

The respective ink donor films S1, S2, and S3 have the same width as the image receiving sheet (i.e., in the direction along the shorter side of an A4 sheet), but are each shorter than the image receiving sheet P in the feed direction of the medium U by a predetermined length, leaving an extending portion D. The extending portion D corresponds to the lower margin defining the printable image area of the image receiving sheet P. If the recording unit U is positioned such that the extending portion D is gripped by a feeding mechanism of a printer, but the ink donor films S1, S2, and S3 are not, the ink donor films S1, S2, and S3 may be separated from the recording unit U while the image receiving sheet P remains at the gripped position and the already printed image remains at a registered position, allowing the ink donor films S1, S2, and S3 to be removed without disturbing the registration of the images. Furthermore, subsequent images can be accurately registered with existing color component images, as the next color component ink donor film S2 or S3 can be layered onto the image receiving sheet P while the image receiving sheet P remains in the gripped position.

Polyethylene terephthalate (PET) films or other polymer films may be used as the base material for the ink donor films Sl, S2, and S3. In order to prevent wrinkling of the ink donor films S1, S2, and S3, the surface of the respective ink donor films S1, S2, and S3 may be treated by aluminum vapor deposition. Alternatively, wrinkling may be prevented by making the ink donor films thicker.

A thermal transfer printer 100 forms a color image on the image receiving sheet P, using the recording unit U. The printer 100 has a housing 3 formed as a substantially rectangular parallelepiped. As control circuit (shown in FIG. 3), a drive circuit 31, a drive motor 32, a thermal line print head 40, (all shown in FIG. 3) are accommodated inside the housing 3. The housing 3 also includes a platen roller 12.

A cover 2 is rotatably supported at two support portions 2X, 2X on the upper surface of the housing 3, and a thermal line print head 40 is disposed on the inner side of the cover 2. FIG. 1 shows a closed state of the cover 2, and FIG. 2 shows an opened state thereof.

A sheet inlet 4 is formed between the cover 2 and the upper surface of the housing 3 (extending between the support portions 2X, 2X), and a sheet outlet 5 is formed between the cover 2 and the front side of the housing 3. The recording unit U is introduced into the printer 100 through the sheet inlet 4 and is drivable by the platen roller 12 in the forward (arrow P in FIG. 1) and reverse (arrow R in FIG. 1) directions. An image can be formed on the image receiving sheet P by the thermal line print head 40, and the sheet can be discharged (and returned in the reverse direction) through the sheet outlet 5.

The cover 2 has a first LED display 107, a second LED display 108, and a third LED display 109 that show the status of the printer 100. The first LED display 107 shows whether the power source is turned on or off, and whether or not any error occurs. The second LED display 108 shows whether or not data is received. The third LED display 109 indicates information regarding a built-in secondary battery 90 (shown in FIG. 3).

A power switch 106 is positioned on the upper side of the housing 3. The power switch 106 is a momentary ON push switch, being usually open, but closed for the duration of an operation of the power switch 106. In the printer 100 of the preferred embodiment, according to the operating states (operating duration and number of operations) of the power switch 106, various states (for example, turning ON or OFF of the power source of the printer 100, a "refresh" discharge of the built-in battery 90, charging of the, built-in battery 90, and form feeding) are changed.

Figure 3:
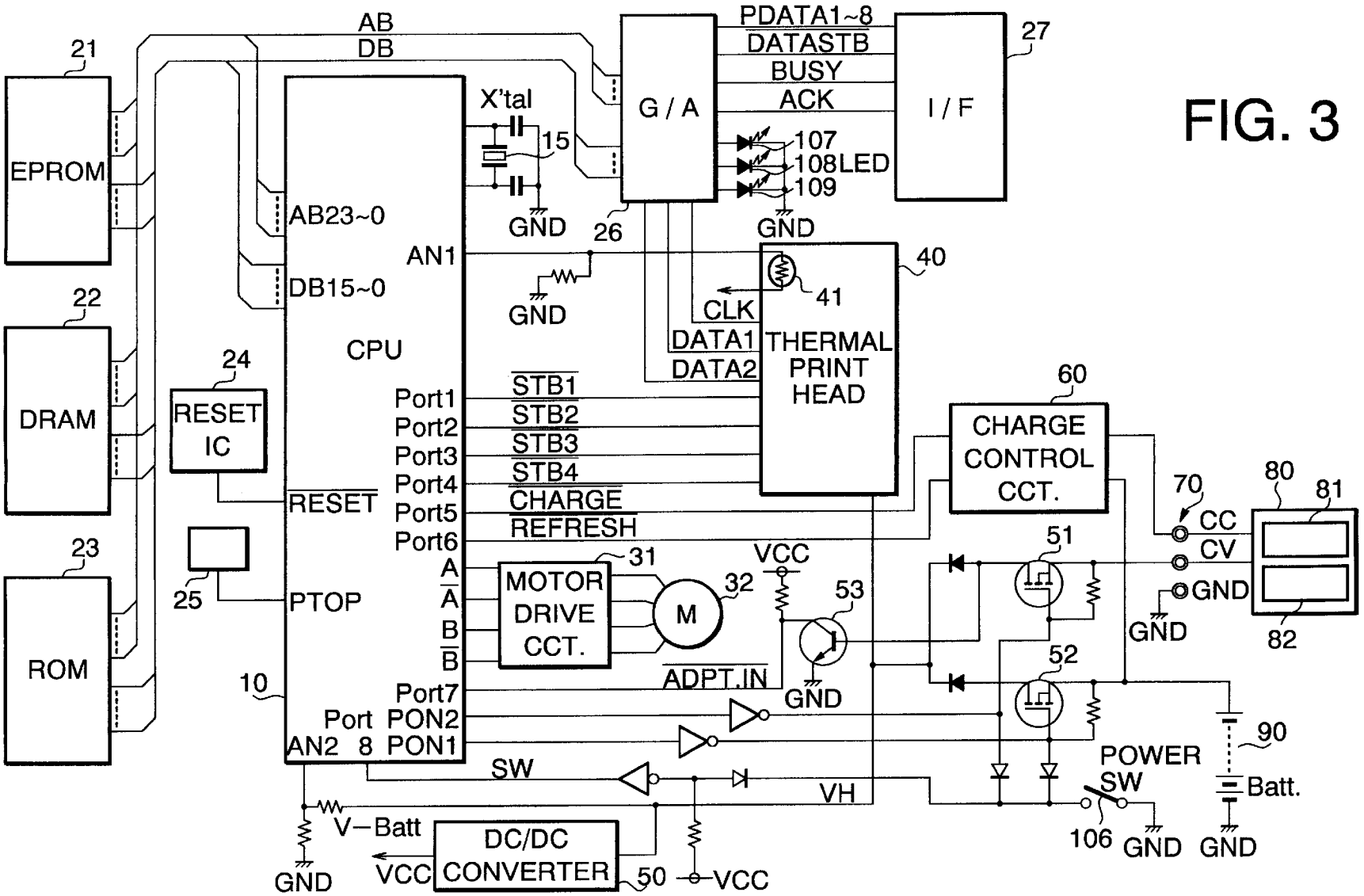
FIG. 3 is a block diagram describing the control circuits of the thermal line printer.

FIG. 3 is a block diagram showing the control circuit of a printer 100 according to the preferred embodiment. A CPU 10 controls the operation of the thermal printer 100. In the embodiment, the CPU 10 is a microprocessor which can address up to 16 megabytes (MB). In this specification, a control line, port or signal having a bar over the label indicates an active low control line, port or signal, respectively.

The CPU 10 transmits address information from address ports AB0 through AB23 via an address bus AB, end transmits and receives data through data ports DB0 through DB15 via a data bus DB. The CPU 10 is connected to an EPROM 21, a dynamic RAM (DRAM) 22, a font ROM 23, and a gate array (G/A) 26, via the address bus AB and data bus DB.

The EPROM 21 stores data and software that control the operation of the thermal printer, including an initialization operation of the thermal printer 100 when the power is turned on. The DRAM 22 includes, among other work areas, an area where a bitmap of an image is developed and an area for storing data transmitted through an interface (I/F) 27. The font ROM 23 stores font data used for developing the bitmapped image stored in the DRAM 22. The CPU 10 uses the gate array (G/A) 26 to exchange data through the interface (I/F) 27, and drive the LED indicators 107, 108 and 109.

The interface (I/F) 27 includes a printer interface (e.g., a Centronics interface) which receives print data and control data from a host computer (not shown). The printer interface portion of the interface I/F 27 has eight data lines PDATA 1 through PDATA 8, and three control lines $\overline{\text{DATASTB}}$, BUSY, and ACK. The eight data lines PDATA 1 through PDATA 8 are used to transfer the print data from the host computer. The $\overline{\text{DATASTB}}$control line initiates the input of data from the host computer to the printer 100. The BUSY control line indicates that the printer 100 cannot accept the print data, while the ACK control line acknowledges reception of the print data.

A divided voltage V-BATT of the built-in battery (or an external DC voltage) is applied to an analog port AN2 of the CPU 10. An analog-to-digital converter (A/D converter, not shown) in the CPU 10 converts the applied analog voltage to a digital value, and the CPU 10 thereby detects the voltage of the built-in battery (or external DC source).

A reset IC 24 transmits a reset signal ($\overline{\text{RESET}}$) to a CPU port $\overline{\text{RESET}}$when the detected voltage level of the battery is lower than a predetermined voltage level. When the $\overline{\text{RESET}}$signal is LOW, the CPU 10 stops operation of the printer 100. Therefore, the printing operation stops when the voltage of the built-in battery (or external DC voltage) is below a predetermined level.

A sensor 25 mounted on the platen roller cover 102 detects the presence of a sheet in a sheet feed path of the printer 100, If a sheet is located in the sheet feed path, the sensor 25 transmits a paper-detect signal to a port PTOP of the CPU 10. By monitoring the port PTOP, the CPU 10 can determine whether the printer 100 has a sheet loaded in the sheet feed path, and therefore whether the printer 100 is ready to start the printing operation.

A reference clock signal CLK is generated by the CPU 10 according to the crystal (X'tal) 15, and is available to the gate array (G/A) 26 via a connection thereto (not shown). In accordance with the reference clock signal CLK, the bitmap of the print data is developed in the DRAM 22. The data written in the DRAM 22 is transmitted to the gate array (G/A) 26 and synchronized with the reference clock signal CLK, before being transferred to the thermal print head 40. The data transferred to the thermal print head 40 is separated into two separate data blocks: DATA1 and DATA2 (described later).

The thermal print head 40 has a plurality of thermal elements (not shown). The heat energy generated by each of the thermal elements is controlled by strobe signals $\overline{STB1}$, $\overline{STB2}$, $\overline{STB3}$, $\overline{STB4}$ (described later), which are transmitted from the ports Port1 through Port4 of the CPU 10. Thus, DATA1 and DATA2 identify the thermal elements to be driven, and strobe signals $\overline{STB1}$ through $\overline{STB4}$ drive the identified thermal elements to generate the required heat energy for printing the image.

A thermistor 41 is provided on the thermal print head 40 for detecting the temperature of the thermal print head 40. The output of the thermistor 41 is input to a port AN1 of the CPU 10. The A/D converter in the CPU 10 converts the signal input to the port AN1, and the CPU thereby detects the temperature of the thermal head 40.

A motor driving signal is transmitted from ports A, $\overline{A}$, B, and $\overline{B}$ for controlling a motor driving circuit 31. The motor driving circuit 31 drives a motor 32 for driving the platen roller 12 and feeding a sheet.

A port PON1 outputs a signal for turning ON or OFF a first field effect transistor (FET) 52. A port PON2 outputs a signal for turning ON or OFF a second FET 51. If an external power source (such as an AC adapter) is used to power the printer 100, a transistor 53 is turned ON thereby changing the signal $\overline{ADPT.IN}$ from High to Low. The CPU 10 monitors the $\overline{ADPT.IN}$ signal at a port Port7, and determines whether the external power supply is connected. If the external power supply is connected (i.e., $\overline{ADPT.IN}$ is Low), then the CPU 10 drives the second FET 51 through port PON2. If the external power supply is not connected (i.e., $\overline{ADPT.IN}$ is High), then the CPU 10 drives the first FET 52 through port PON1.

When the switch 106 is first turned ON, one of the second FET 51 or first FET 52 is turned ON depending on whether power is supplied to a DC/DC converter 50 from the external power source or from the built-in battery 90, respectively. The DC/DC converter 50 outputs a voltage Vcc which powers the CPU 10, the EPROM 21, the DRAM 22 and the ROM 23. In this embodiment, the voltage Vcc is 5V.

When both the second and first FETs 51 and 52 are turned OFF by the signals output from the ports PON1 and PON2, power is not supplied to the DC/DC converter 50. Accordingly, power to the CPU 10 is cut and the printer 100 is turned off. In order to turn the printer 100 on it is necessary to press the switch 106, thereby providing power to the second and first FETs 51 and 52.

The built-in battery 90 is a rechargeable battery, for example, a Nickel Cadmium battery. The battery 90 supplies 14.4V (DC) to the printer 100. A power source connector 70 is provided to connect the external power source, in this case an AC adapter 80, to the printer 100. The AC Adapter 80 includes a constant current, source 81 and a constant voltage source 82. An output CC of the constant current source 81 is connected to a battery charge control circuit 60, and is used to recharge the battery 90. An output CV of the constant voltage source 82 is connected to an input of the DC/DC converter 50.

As described, the constant current source 81 is provided in the AC adapter 80, and not in the printer 100, since the constant current source 81 is only required for charging the battery. Therefore, the size and weight of the printer 100 can be reduced.

The thermal head 40 includes 2560 thermal elements arranged in a line, the line of thermal elements having a length equivalent to a width of one sheet of imageable media used in the printer 100. Print data for one half of the thermal elements (the first through 1280th elements) are grouped as DATA1, while print data for the remaining half of the thermal elements (the 1281st through 2560th elements) are grouped as DATA2. As described above, the data DATA1 and DATA2 are transferred to the thermal head 40 synchronously with the reference clock signal CLK.

The thexmal elements are divided into four groups, with respective groups driven by the strobe signals $\overline{STB1}$, $\overline{STB2}$, $\overline{STB3}$, and $\overline{STB4}$, while the number of simultaneously driven thermal elements may be varied in accordance with the power available from the battery 90. That is, if the power available from the battery 90 is low, then the groups of thermal elements may be driven sequentially, but if the battery 90 is fully charged or the AC adapter 80 is used, then all four groups of thermal elements may be driven simultaneously.

A printer 100 according to the preferred embodiment may be actuated in three modes: a print mode, a refresh mode for "refresh" discharging of the built-in battery 90, and a charging mode for charging the built-in battery 90. The printer 100 is controlled by means of the power switch 106 for changing between these three modes, and for turning on or off the power source.

When the power source is in an idle state (i.e., both of the first and second FETs 52 and 51 are OFF), and the power switch 106 is operated one time for a short duration (being shorter than a predetermined operating duration), the printer 100 shifts to the print mode. If no print data is received from the host computer (not shown), for a predetermined duration of time in the print mode, the printer 100 is automatically returned to the hold state by the CPU 10. In the hold state, if the power switch 106 is pressed for a long duration (being longer than the predetermined operation duration), the CPU 10 shifts the printer 100 to the refresh mode of the built-in battery 90. Following the discharge of the built-in battery 90 to a predetermined discharged state, the CPU 10 shifts the printer directly to the charging mode, and upon completion of the charging of the built-in battery 90, the printer 100 is automatically returned to the hold state by the CPU 10. Alternatively, when the power switch 106 is operated for the aforementioned long duration while the printer 100 is in the refresh discharge mode, the CPU 10 switches the printer 100 to the charging mode. In any of the above states, when the power switch 106 is operated twice successively for the aforementioned short duration, the CPU 10 shifts the printer 100 to the idle states.

Figure 4:
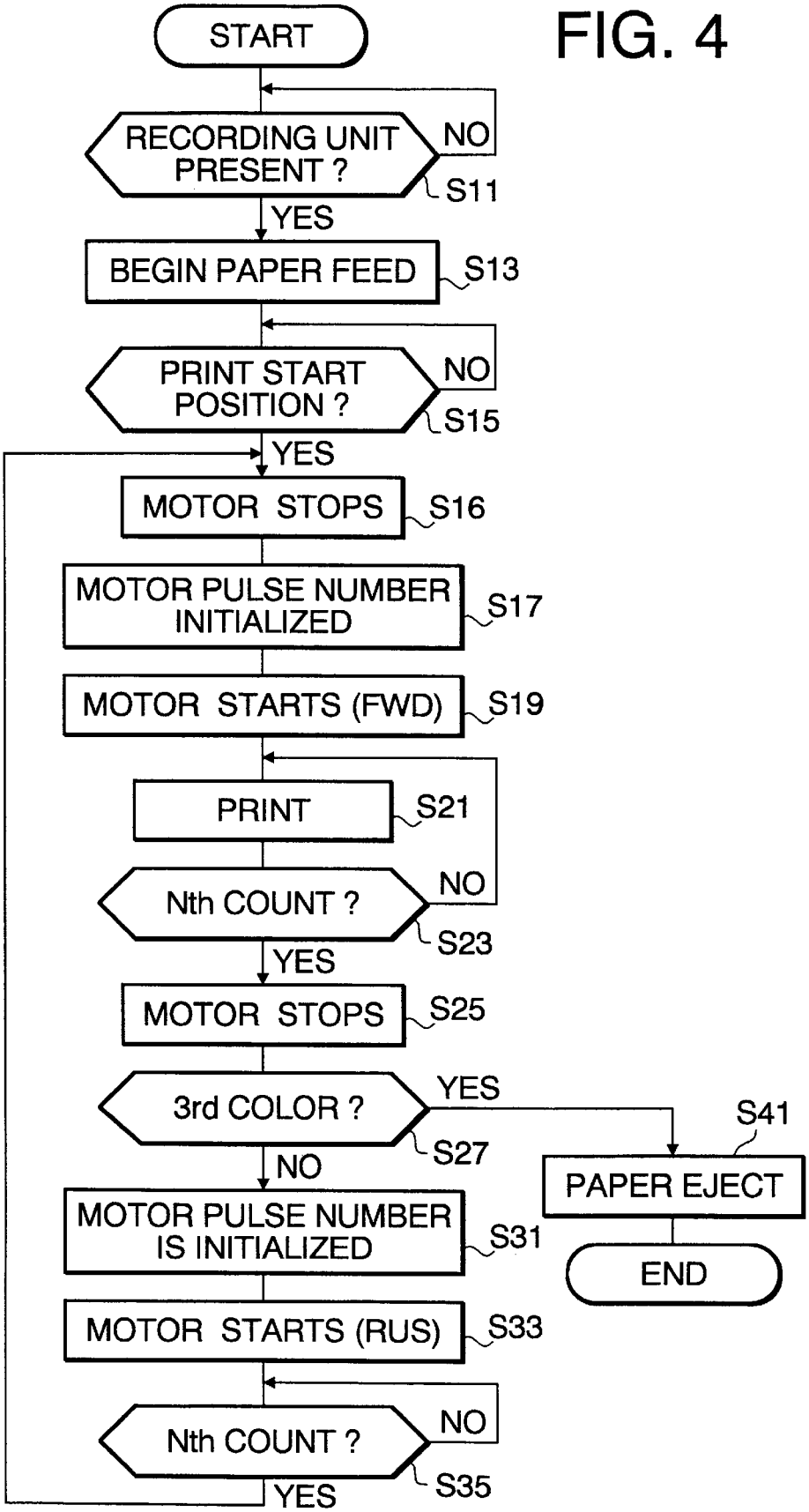
FIG. 4 is a flow chart describing the control of a printer system according to the preferred embodiment.

FIG. 4 is a flow chart showing a feed control process for feeding the recording unit U and transferring images to the recording unit U. The process of FIG. 4 is executed after the power switch 106 is operated for the short duration while turning the power source ON.

The process first loops until the paper sensor 25 detects the insertion of a recording unit U into the printer 100 at step S11. If a recording unit U is inserted (Y at step S11, then the motor 32 is driven in step S13, driving the platen roller 12 to feed the image receiving sheet P by a predetermined distance in the forward direction (shown by the arrow F in FIG. 1).

The predetermined distance is enough to move the recording unit U to a print starting position, and is slightly shorter than the length of the extending portion D corresponding to the lower margin of the image receiving sheet P. The predetermined distance to the print starting position is detected by, for example, detecting whether or not the number of drive pulses of the motor 32 reaches a predetermined number. Moving the recording unit U (fed, at this point, only by the image receiving sheet P) by the predetermined distance allows the first color component image and subsequent color component images to be accurately registered with reference to the print starting position.

It should be noted that when the recording unit U is inserted in the printer, only the first, yellow ink donor film S1 is layered on the image receiving sheet P, and the remaining magenta ink donor film S2 and cyan ink donor film S3 are held away from the paper inlet 4 of the printer 100, as shown in FIG. 1. Alternatively, the ink donor films S2 and S3 may be moved away from the paper inlet 4 following step S16, described below. Hereinafter, a "single ink donor film" is the yellow ink donor film S1 on the first pass (from step S16 through S35), the magenta ink donor film S2 on the second pass (from step S16 through S35), and the cyan ink donor film on the third pass (from step S16 through S27).

The process loops at, step S15 as the image receiving sheet is fed, and when the print starting position has been reached (Y at step S15), the process proceeds to step S16 where the motor 32 is stopped.

Actual printing is started after the reception of printing data from the host computer (not shown), and the image receiving sheet P advances further and the ink donor film-reaches the thermal head 40.

At step S16, if the CPU 10 detects that the power switch 106 is operated for the aforementioned short duration, the process proceeds from step S16 to step S17. In step S17, a motor drive pulse counter incorporated in the CPU 10 is initialized to zero (0) corresponding to the printable length of the image. The process continues to step S19, wherein drive pulses are transmitted to the motor drive circuit 31 via the ports A, $\overline{A}$, B, and the motor 32 is thereby started to drive the platen roller 12 in the forward direction, feeding the print receiving sheet P and single ink donor film in the forward direction.

Subsequently, in step S21, the print data DATA1 and DATA2 are sent to the thermal line print head 40 in synchronization with the timing of the transfer clock CLK. Consequently, one line of color component line image data is formed as one line of color component image on the image receiving sheet P. The platen roller 12 continues to rotate, feeding the image receiving sheet P and single ink donor film forward by a distance corresponding to one line of the image, and the CPU, 10 increments the value of the motor drive pulse counter incorporated therein.

In step S23, the CPU 10 checks if a number of pulses N corresponding to the printable length of the print receiving sheet P has been reached. When the motor drive pulse counter reaches the number N of pulses (Y at step S23), the process continues to step S25. If the motor drive pulse counter has not yet reached the number N of pulses, the process returns to step S21 and continues (N at step S23).

Thus, steps S21 and S23 are repeated until the recording unit U (specifically the print receiving sheet P and layered single ink film) is caused to advance to a print termination position, corresponding to the end of the printable length of the print receiving sheet P. The print termination position is detected by detecting whether or not the value of the motor drive pulse counter reaches the predetermined number of pulses value N.

As previously described, if the motor drive pulse counter reaches the number N (Y at step S23), the process continues to step S25. At step S25, the output of drive pulses from the ports A, $\overline{A}$, B and $\overline{B}$ is stopped. The motor 32 stops, and the recording unit U comes to a stop temporarily at the print termination position.

In step S27, the CPU 10 checks whether or not all the three colors (yellow, magenta and cyan) are printed, that is, whether or not three passes have been made through the printing process. In the preferred embodiment, the CPU 10 incorporates a print color counter incorporated that is incremented according to the color being printed. That is, the print color counter is set to zero (0) in the default state, and is incremented each time the print process is carried out for a color component ink donor film. For example, the print color counter is incremented with the start of the motor in step Sl9.

After step S25, the process proceeds to step S27. In step S27, the CPU checks whether all three color component images have been printed (for example, with reference to the aforementioned print color counter). If all three color component image have been printed (Y at step S27), the process branches to step S41. If less than three color component images have been printed (N at step S27), the process continues to step S31.

In step S31, the motor drive pulse counter is again initialized to zero (0). In step S33, the output of drive pulses from the ports A, $\overline{A}$, B, and $\overline{B}$, is started, and the motor 32 rotates in the reverse direction, driving the platen roller 12 to feed the recording unit U in the reverse direction (shown by arrow R in FIG. 1).

In step S35, the CPU 10 checks if a number of pulses N corresponding to the printable length of the print receiving sheet P has been reached. That is, the CPU l0 checks whether or not the recording unit U has returned to the print starting position. The process loops at step S35 until the motor drive pulse counter reaches the number N of pulses. When the motor drive pulse counter reaches the number N of pulses (Y at step S35), the process returns to step S16.

Thus, step S35 is repeated until the recording unit U (specifically the print receiving sheet P and layered single ink film) is reversed to the print starting position, corresponding to the beginning of the printable length of the print receiving sheet P. Since the transfer distance from the print starting position to the print termination position is equal to that from the print termination position to the print starting position, the print starting position is detected by detecting whether or not the value of the motor drive pulse counter reaches the predetermined number of pulses value N. By feeding the recording unit U such that the extending portion D is gripped by the platen roller 12 and the thermal head 40 at the print starting position, but the ink donor films S1, S2, and S3 are not gripped, the ink donor films S1, S2, and S3 may be separated from the recording unit U while the image receiving sheet P remains at the gripped, print starting position and the already printed image remains at a registered position, allowing the ink donor films S1, S2, and S3 to be removed without disturbing the registration of the images. Furthermore, subsequent images can be accurately registered with existing color component images, as the next color component ink donor film S2 or S3 can be layered onto the image receiving sheet P while the image receiving sheet P remains in the gripped, print starting position.

As previously described, in step S16, the output of drive pulses from the ports A, $\overline{A}$, B, and $\overline{B}$ is stopped, the motor 32 stops, and the feed of the recording unit U is thereby stopped temporarily. The process enters a standby state. As previously described, the image receiving sheet P is longer by length of the extending portion D than the ink donor films S1, S2, and S3.

Since the image receiving sheet P is therefore held at the print starting position between the platen roller 12 and the thermal line printhead 40 within the extending portion D, the layered single ink donor film (having already been used to transfer a color component image to the image receiving sheet P) is not held by the platen roller 12 and thermal line printhead 40. Accordingly, the ink donor film S1 is easily peeled off and separated from the adhering portion T. That is, following a pass through the printing process, at the print starting position, a single used ink donor film is separated at the perforations L, and is removed from the recording unit U.

At this point, the next single ink donor film is layered on the image receiving sheet P while the image receiving sheet P is still held in the print starting position. That is, after the yellow ink donor film S1 has been used, it is removed from the recording unit U, and the magenta ink donor film S2 is layered on the print receiving sheet, while after the magenta ink donor film S2 has been used and removed, the cyan ink donor film S3 is layered on the print receiving portion.

If an ink donor film remains (just before the second pass through the printing process, but not just before the third pass through the printing process), the remaining ink donor film is placed away from the paper inlet 4 as previously described with reference to FIG. 1.

On the second pass through the printing process (with the magenta ink donor film S2 layered on the image receiving sheet P), the process again shifts from Step S16 to Step S17 when the power switch 106 is operated for the aforementioned shorter duration. Subsequently, the process is carried out from step S17, through a "N" decision at step S27, to step S35, and then returns to step S16, where the magenta ink donor film S2 is separated. Then, on the third pass through the printing process (with the cyan ink donor film S3 layered on the image receiving sheet P), the process shifts from step S16 to step S17 when the power switch is pressed, and the process proceeds through step S17 to S27 as previously described.

On the third pass, when all three color component images have been transferred to the image receiving sheet P (Y at step S27), the process branches to step S41. In step S41, the motor 32 is driving in the forward direction, ejecting the recording unit U through the paper outlet 5. The adhering portion T and cyan ink donor film S3 secured to the adhering portion T are ejected along with the image receiving sheet P. The last, cyan ink donor film S3 is then peeled away from the image receiving sheet P, which has a three color component image printed thereon.

Thus, in the preferred embodiment, the image receiving sheet P is driven in the forward direction along, with the predetermined ink donor films S1, S2, and S3 in order to print the respective color component images of a color image. Each time a color component image has been printed, the recording unit U is fed in the reverse direction (unless all three color component images have been printed) to stop at the print starting position, where the already used single ink donor film is removed. The process is repeated for each single ink donor film, and the last single ink donor film is ejected from the printer 100 through the paper outlet 5 along with the remainder of the recording unit U (including the printed image receiving sheet P and the adhering portion T).

Thus, according to the preferred embodiment, in a thermal transfer printer system which carries out color printing, it is possible to make the system light and small. The recording unit U allows the easy printing and removal of color component ink donor films, and can be printed upon without any special ink ribbon in the printer 100.

Although the preferred embodiment includes recording unit U having three color component ink donor films, the embodiment may be practiced with any number of ink donor films without departing from the spirit or scope of the invention. For example, the recording unit may employ a CMYK system (Cyan, Magenta, Yellow, Black) and a black ink donor film may be included, or the recording unit may employ less than the three colors. Furthermore, the printer 100 can alternatively be made with a monochrome print mode.

The present disclosure relates to subject matter contained in Japanese Patent Application No. HEI 07-142701, filed on May 17, 1995, which is expressly incorporated herein by reference in its entirety.

What is claimed is:

1. A printer system, comprising:

a recording unit including an image receiving sheet and a plurality of ink donor films of differing colors individually layerable on the surface of said image receiving sheet and successively layered on said image receiving sheet, said image receiving sheet being attached to said plurality of ink donor films at an adhering portion extending along one end of said image receiving sheet, said adhering portion extending in a direction transverse to a feeding direction of said image receiving sheet, each of said ink donor films being removable from said image receiving sheet;

a printing head;

a feeding device that feeds said image receiving sheet and a predetermined one of said ink donor films individually layered on said image receiving sheet past said printing head, in a forward direction from a print starting position to a print termination position and in a reverse direction from the print termination position to the print starting position;

a detector that detects a feeding distance of said image receiving sheet in said forward and reverse directions; and a controller that controls said feeding device to stop when said image receiving sheet reaches the print starting position and the print termination position and that terminates feeding of said image receiving sheet in the forward direction before the adhering portion reaches said printing head.

2. The printer system according to claim 1, wherein each of said plurality of ink donor films is shorter in a feeding direction than said image receiving sheet.

3. The printer system according to claim 2, wherein a distance from said print starting position to said print termination position is longer than each of said plurality of ink donor films and shorter than said image receiving sheet.

4. The printer system according to claim 1, wherein said controller controls said feeding device to feed said image receiving sheet of said recording unit, in said forward and in said reverse directions, a number of times corresponding to a number of said plurality of ink donor films.

5. The printer system according to claim 4, wherein said controller includes a counting device that counts said number of times said image receiving sheet is fed in said forward and in said reverse directions, and a checking device that checks if said number of times corresponds to said number of said plurality of ink donor films.

6. The printer system according to claim 5, wherein said controller controls said feeding device to eject said recording unit from said feeding device in response to said checking device.

7. The printer system according to claim 5, further comprising an operating switch, and wherein said controller includes a switch checking device, connected to said operating switch, that pauses said feeding before each feeding of said image receiving sheet in said forward direction, and said controller feeds said image receiving sheet in said forward direction when said switch checking device detects an operation of said operating switch.

8. The printer system according to claim 1, said feeding device forwardly feeding said recording unit to said printing head a number of times corresponding to the number of said plurality of ink donor films, a predetermined one of said plurality of ink donor films being layered onto said image receiving sheet for each forward feeding of said recording unit and the other of said plurality of ink donor films not being layered on said receiving sheet, said predetermined one of said plurality of ink donor films being removed from said recording unit after each predetermined one of said plurality of ink donor films layered onto said image receiving sheet has been fed to said printing head.

9. A printer system, comprising:

a recording unit including an image receiving sheet and a plurality of ink donor films of differing colors individually layerable on a surface of said image receiving sheet and successively layered on said image receiving sheet, said image receiving sheet being attached to said plurality of ink donor films at an adhering portion extending along one end of said image receiving sheet, said adhering portion extending in a direction transverse to a feeding direction of said image receiving sheet;

a thermal printhead that forms an image on said image receiving sheet via at least one of said plurality of ink donor films;

a feeding device that feeds said recording unit past said thermal printhead;

a control device that controls said feeding device and said thermal printhead, to feed said image receiving sheet individually layered together with each one of said plurality of ink donor films in a forward direction from a starting position past said thermal printhead to form a color component image, and to feed said image receiving sheet individually layered together with said each one of said plurality of ink donor films in a reverse direction to said starting position said control device further terminates feeding of said image receiving sheet in the forward direction before the adhering portion reaches said thermal printhead.

10. The printer system according to claim 9, further comprising:

a detector that detects a feeding distance of said image receiving sheet in said forward and reverse directions.

11. The printer system according to claim 10, each of said plurality of ink donor films being shorter in a feeding direction than said image receiving sheet and being removable from said image receiving sheet.

12. The printer system according to claim 10, wherein a distance from said print starting position to said print termination position is longer than each of said plurality of ink donor films and shorter than said image receiving sheet.

13. The printer system according to claim 9, wherein said controller controls said feeding device to feed said image receiving sheet of said recording unit, in said forward and in said reverse directions, a number of times corresponding to a number of said plurality of ink donor films.

14. The printer system according to claim 13, wherein said controller includes a counting device that counts said number of times said image receiving sheet is fed in said forward and in said reverse directions, and a checking device that checks if said number of times corresponds to said number of said plurality of ink donor films.

15. The printer system according to claim 14, wherein said controller controls said feeding device to eject said recording unit from said feeding device in response to said checking device.

16. The printer system according to claim 14, further comprising an operation switch, and wherein said controller includes a switch checking device, connected to said operating switch, that pauses said feeding before each feeding of said image receiving sheet in said forward direction, and said controller feeds said image receiving sheet in said forward direction when said switch checking device detects an operation of said operating switch.

17. The printer system according to claim 9, each of said plurality of ink donor films of said recording unit being self-supporting and being individually removable from said recording unit.

18. The printer system according to claim 9, said feeding device forwardly feeding said recording unit to said thermal printhead a number of times corresponding to the number of plurality of ink donor films, a predetermined one of said plurality of ink donor films being layered onto said image receiving sheet for each forward feeding of said recording unit and the other plurality of said ink donor films not being layered on said receiving sheet, said predetermined one of said plurality of ink donor films being removed from said recording unit after each predetermined one of said plurality of ink donor films layered onto said image receiving sheet has been fed to said thermal printhead.

19. A recording unit for use with a thermal transfer printer, said recording unit comprising:

an image receiving sheet; and a plurality of ink donor films of differing colors, each of said ink donor films being shorter than said image receiving sheet and individually removable from said image receiving sheet, said plurality of ink donor films being successively attached to an adhering portion extending along one end of said image receiving sheet in a direction perpendicular to a feeding direction of said recording unit.

20. The recording unit according to claim 19, wherein each of said plurality of ink donor films and said image receiving sheet are formed with perforations, parallel to and at an edge of said adhering portion, for separating each of said plurality of ink donor films and said image receiving sheet from said adhering portion.

21. The recording unit according to claim 19, wherein said adhering portion is formed by successively adhering said image receiving sheet and each of said plurality of ink donor films at said one feeding direction end of said image receiving sheet.

22. The recording unit according to claim 21, wherein said adhering portion is formed by successively adhering said image receiving sheet and each of said plurality of ink donor films by means of a peel-off adhesive.

23. The recording unit according to claim 19, wherein said image receiving sheet is substantially as wide, in a direction perpendicular to a feeding direction of said recording unit, as each of said plurality of ink donor films, and wherein said image receiving sheet is longer by a predetermined extending portion, in said feeding direction and at an opposite end of said recording unit to said adhering portion, than each of said plurality of ink donor films.

24. The recording unit according to claim 23, wherein said extending portion corresponds to a lower margin defining a printable image area of the said image receiving sheet.

25. The recording unit according to claim 19, wherein each of said plurality of ink donor films is treated by aluminum vapor deposition.

26. The recording unit according to claim 19, wherein said plurality of ink donor films comprises at least three ink donor films, said at least three ink donor films including a cyan ink donor film, a magenta ink donor film, and a yellow ink donor film.

27. The recording unit according to claim 19, wherein said plurality of ink donor films comprises at least four ink donor films, said at least three ink donor films including a cyan ink donor film, a magenta ink donor film, a yellow ink donor film, and a black ink donor film.

28. A method of printing utilizing the recording unit of claim 19, using a thermal transfer printer and a feeding mechanism for feeding the recording unit past the thermal transfer printer, wherein the method comprises:

layering a predetermined one of said plurality of ink donor films on the image receiving sheet while positioning the other of the plurality of ink donor films to not be layered on said image receiving sheet;

feeding the ink receiving sheet and layered ink donor film past the printhead in a forward direction from a print start position to a print termination position and in a reverse direction from the print termination position to the print start position; and removing the predetermined layered ink donor film from said recording unit.

29. The method of printing according to claim 28, further comprising repeating the steps of the layering, feeding and removing for each of said plurality of ink donor films.

30. The recording unit according to claim 19, said plurality of ink donor films of different colors being self-supporting.

31. A recording unit for use with a thermal transfer printer, said recording unit comprising:

an image receiving sheet; and a plurality of ink donor films of differing colors layerable on a surface of said image receiving sheet, each of said ink donor films being shorter than said image receiving sheet and removable from said image receiving sheet, said plurality of ink donor films are successively layered on said image receiving sheet and successively attached to an adhering portion extending along one end of said image receiving sheet in a direction perpendicular to the feeding direction of said recording unit, each of said plurality of ink donor films and said image receiving sheet are formed with perforations, parallel to and at an edge of said adhering portion, for separating each of said plurality of ink donor films and said image receiving sheet from said adhering portion.

32. The printer system according to claim 1, each of said plurality of ink donor films of said recording unit being self-supporting and being individually removable from said recording unit.

* * * * *